United States Patent [19]

Lipinski

[11] Patent Number: 4,709,782

[45] Date of Patent: Dec. 1, 1987

[54] SKID-OUT HIGHRISE FIRE ESCAPE DEVICE

[75] Inventor: Henry Lipinski, 1832-20th St., Wyandotte, Mich. 48192

[73] Assignees: Henry Lipinski; Theresa Janet Lipinski; James Robert Sobocienski; Lorraine Sobocienski, all of Wyandotte, Mich.

[21] Appl. No.: 2,953

[22] Filed: Jan. 13, 1987

[51] Int. Cl.[4] ..... A62B 1/20

[52] U.S. Cl. ..... 182/3; 182/82

[58] Field of Search ..... 182/3, 5, 82, 48, 9

[56] References Cited

U.S. PATENT DOCUMENTS

| | | | |
|---|---|---|---|
| 3,831,711 | 8/1974 | Smith | 182/82 |
| 3,944,021 | 3/1976 | Smith, Jr. | 182/82 |
| 4,121,689 | 10/1978 | Bonvin | 182/82 |
| 4,295,543 | 10/1981 | Graham | 182/3 |
| 4,350,224 | 9/1982 | Jochum | 182/82 |
| 4,406,349 | 9/1983 | Vilchek | 182/82 |
| 4,466,507 | 8/1984 | Itano | 182/82 |
| 4,467,889 | 8/1984 | Maubach | 182/82 |
| 4,469,198 | 9/1984 | Crump | 182/82 |
| 4,485,891 | 12/1984 | Friess | 182/82 |
| 4,499,966 | 2/1985 | Milne | 182/3 |

*Primary Examiner*—Reinaldo P. Machado
*Attorney, Agent, or Firm*—Joseph J. Goluban

[57] ABSTRACT

A highrise fire escape device gravity operated and particularly adaptable for use in highrise building and modern skyscraper structures as an escape apparatus from any floor of a building for use in the rescue of an occupant who may be trapped and prevented from using the conventional stairways or elevator due to a natural or man-made disaster such as fire, electrical or power failure, building collapse or personal injury of the occupants, etc.

The apparatus or device comprises the combination of a vertical skid track member attached to the wall of a building with a skid which is inserted into a guide channel located in the track. The skid track is designed to be attached to either a new or existing building with access to the skid track being available at the outside of the building at predetermined locations, such as, building corners or a plurality of locations intermediate to the corners between the building windows so as not to impede the architecture design of the building. The skid track has a back and guide portion with a plurality of spring loaded or hinged skid track doors which allows the insertion of a skid to which the occupant of a building may be attached. The skid is so designed to allow its movement down the vertical skid track with the occupant attached, with its rate of descent being controlled by a plurality of descent retarders suitably disposed along the skid tracks entire length. The descent retarder is disposed within the back section of the skid track and partially protrudes into the guide channel of said track. As the skid moves down the guide channel of the skid track it comes into fractional contact with the biased plane frictional surface of the plurality of protruding descent retarders disposed along its vertical axis causing the descent retarder to be displaced in a horizontal direction perpendicular to direction of the skid movement. The movement of the descent retarders in a horizontal direction is resisted by means just as a plurality of springs interposed between the rear of the descent retarders and the inside the back portion of the skid track. While the majority of the descent retarders are spaced uniformly along the entire length of the vertical skid track, there are some that are placed in a closer or cluster configuration near the end of the vertical skid track to more greatly impede the rate of descent or velocity of the occupant user so as to prevent forceful contact with the ground. During an emergency, a building occupant may put on a harness of any standard construction and attach it to the skid which can easily be inserted into the guide portion of the vertical skid track through any of the plurality of track doors disposed along said skid track.

60 Claims, 12 Drawing Figures

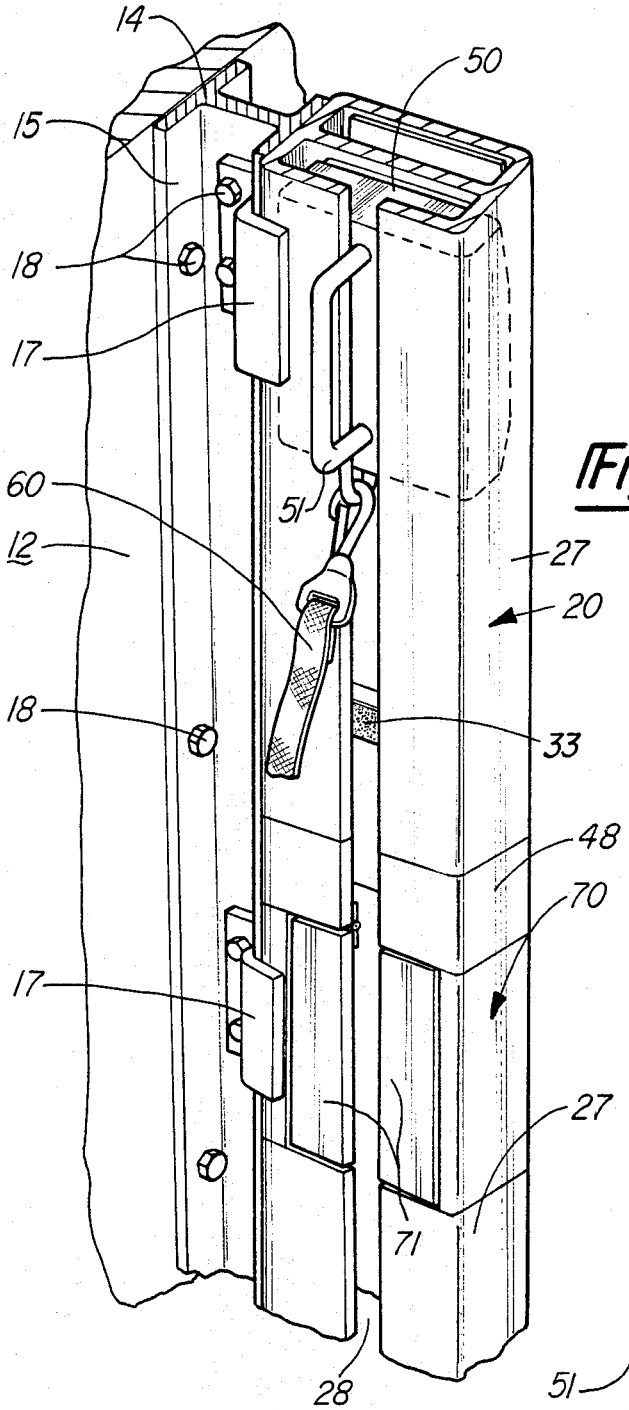
Fig-10
Fig-11
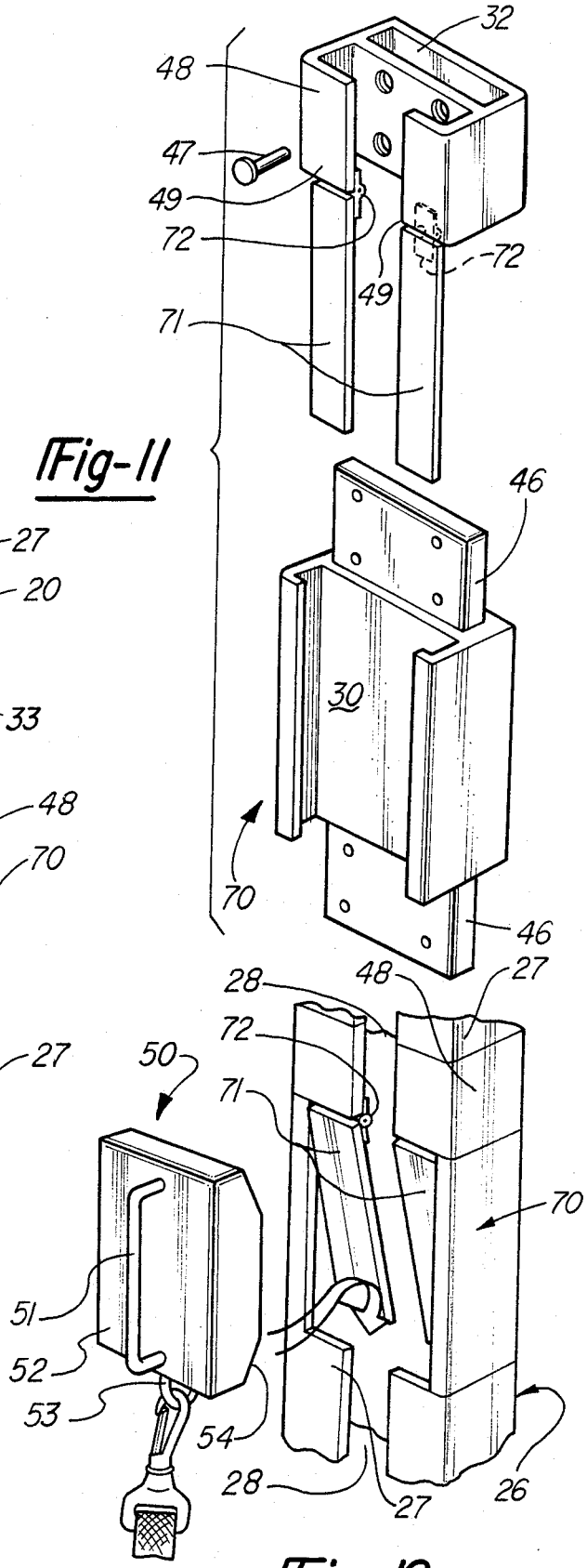
Fig-12

SKID-OUT HIGHRISE FIRE ESCAPE DEVICE

BACKGROUND OF THE INVENTION

1. Field of the Invention

This invention relates in general to fire escape device for use in connection with multi-floor structures, such as, highrise buildings and modern skyscrapers and the like, and in particular to a fire escape device including one or more vertical skid tracks fixedly mounted on a front of a building in the range of escape windows of the building which allows the building occupants to safely exit in the event of an emergency when the conventional ways of exiting said structure are not safe or unavailable.

2. Description of Prior Art

In the event of a highrise office building fire conventional routes of escape are often not available. For example, stairways can become smoke filled and outside the reach of conventional rescue equipment, such as, hook and ladder trucks. In addition, elevators can become disabled in times of fire and in any event it is generally advisable to avoid elevators during fire emergencies and the resulting dangers of being trapped between floors during an electrical power failure. Thus, a need exists for a simple, reliably, automatic and aesthetically pleasing escape apparatus which can be used to transport people safely out of a structure during a fire emergency.

The first commonly acceptable solution to problems relating to a highrise fire was to provide structures with fire escape stairs on the outside of the structure. However, due to the unsightly and incompatible appearance of the outside fire escapes, their high initial costs and maintenance and the use by unwanted intruders to gain illegal entry into a structure their use is currently not in vogue.

In an attempt to overcome the problems associated with the use of fire escape stairs to exit an unsafe building other types of escape devices have been created. Once such device is disclosed in U.S. Pat. No. 4,121,689 (Bonvin) includes an escape mechanism for enabling a person to escape at any floor of a building, the escape mechanism including a vertically disposed hollow rail and at least one rack disposed within the rail. At least one running and suspension apparatus adapted to be introduced within the rail, where the apparatus is equipped with support members and includes an engagement portion having at least one pinion. The pinion engages the rack to allow the apparatus to move along the rail only upon rotation of the pinion. The engagement portion includes impeding assemblies having inertial escapement members for hindering the rotation and for slowing the descent of the apparatus by gravity while the engagement portion is engaged within the rail.

Another type of prior art device utilizes a complex gear track assembly which is disclosed in U.S. Pat. No. 4,406,349 (Vilchek) includes an emergency escape apparatus includes a gear track mounted vertically on an exterior surface of a building. A carriage is provided with guide rollers which engage a guide track oriented adjacent and parallel to the gear track. A gear wheel is rotatably mounted on the carriage and is maintained in positive engagement with the gear track by the guide rollers. The carriage includes automatic brakes which serve to limit the maximum downward velocity of the carriage, and a boatswain's chair is attached to the carriage to secure one or more persons to the carriage for transport down the outside of the building.

Still another example of a prior art device that attempts to solve the problems associated with the exiting of a structure during an emergency is disclosed in U.S. Pat. No. 4,485,891 (Friess) includes an emergency escape system, such as for use in exiting from a high-rise building. The system includes a personnel lowering device adapted to be clamped to a vertically mounted I-beam running the full height of the building from which a quick escape is desired. The lowering device, which controls the rate of descent of the user thereof through a contained braking system, includes a (1) spring-biased pivotal clamping mechanism, activated by contact with the outer face of the I-beam and (2) knurled roller which rolls along said face and drives two drums enclosed in a viscous fluid, such as silicon oil having a viscosity of 300 SSU. As the rate of descent of the lowering device begins to increase through gravity and the weight of the descending personnel, drum RPM increases and fluid shear increases. In a short period of time after the descent begins the fluid shear forces on the roller driven drums are balanced such that the rate of descent is controlled.

While there are a number of advantages associated with each of the above described escape devices there are also disadvantages associated with their use, viz.:

1. Very complex mechanism which requires outside power source (Bonvin).
2. Very complex mechanism which requires the carriage to return to the next user before exiting of the structure can be completed (Vilchek); and
3. Requires the return of the mechanism after its use and periodic maintenance to insure the fluid is not depleted or low (Friess).

SUMMARY OF THE INVENTION

In accordance with the present invention, a gravity operated highrise fire escape device for use in highrise buildings and modern skyscraper structures has been provided which comprises a simple, and efficient alternative to the prior art. It is also the object of the present invention to provide an improved highrise escape device which is aesthetically pleasing.

Another object of the present invention is to provide an improved highrise escape device which is economical.

Another object of the present invention is to provide an improved highrise escape device which requires little or no maintenance.

Still another object of the present invention is to provide an improved highrise escape device which requires no outside power source.

Still another object of the present invention is to provide an improved highrise escape device which is adaptable to either new or existing structures.

Still another object of the present invention is to provide an improved highrise escape device which does not require the return of the transporting member of element before the next use.

A still further object of the present invention is to provide an improved highrise escape device which is simple to use.

A still further object of the present invention is to design a highrise escape device which can be easily affixed to structure.

A further object of the present invention is to provide a highrise escape device which prohibits the use by intruders to enter a structure without authorization.

A further object of the present invention is to provide a simplified construction for a highrise escape device which utilizes a skid and skid track in combination with means for resisting said skid vertical descent.

A further object of the present invention is to provide a plurality of descent retarder which resists the vertical displacement of the skid.

A further object of the present invention to provide a plurality of skid pads which may be placed throughout a building in strategic locations.

Further objects and advantages of this invention will be apparent from the following description and appended claims, reference being made to the accompanying drawings forming a part of this specification, wherein like reference characters designate corresponding parts in the several views.

BRIEF DESCRIPTION OF THE DRAWINGS

The foregoing and other objects, features and advantages of the invention will be apparent from the following more particular description of a preferred embodiment of the invention, as illustrated in the accompanying drawings, in which:

FIG. 10 is a fragmentary perspective view of a skid track having a flapper plate door, being attached to the outside of a highrise structure with the skid inserted into the skid track guide channel.

FIG. 11 is an exploded perspective view of a skid Track Door Assembly showing a flapper plate door connected to the coupling sleeve.

FIG. 12 is a fragmentary perspective view of a skid track and skid being inserted into the skid track guide channel through a flapper plate door.

It is to be understood that the present invention is not limited in its application to the details of construction and arrangement of parts illustrated in the accompanying drawings, since the invention is capable of other embodiments and of being practices or carried out in various ways within the scope of the claims. Also, it is to be understood that the phraseology and terminology employed herein is for the purpose of description and not of limitation.

DETAILED DESCRIPTION OF THE PREFERRED EMBODIMENT

Figure 1:
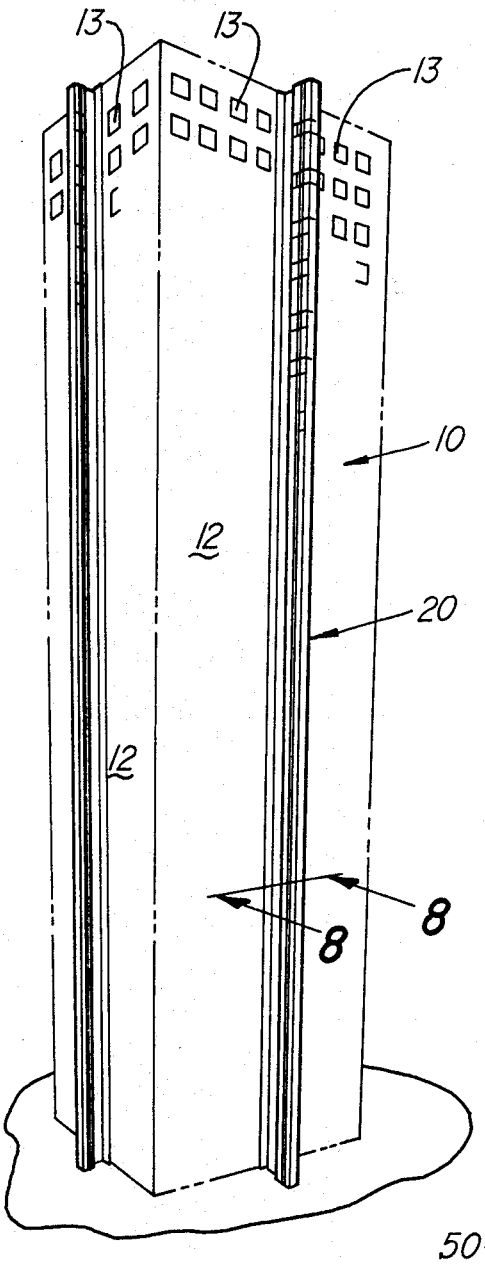
FIG. 1 is a perspective view of the skid-out highrise fire escape device attached to the outside of a highrise structure.

Referring to FIG. 1 which is a perspective view of the outside of a highrise structure 10 to which my skid-out highrise fire escape device generally designated by numeral 20 is attached. My skid-out highrise fire escape device 20 is vertically disposed along an outside wall 12 of a highrise structure 10. The escape device 20 includes a vertical skid track 26 and skid 50.

The skid track 26 is designed to be attached to the outside wall 12 of either a new or existing building with access to the skid track 26 being available at the outside of the building at predetermined locations, such as, building corners or a plurality of locations intermediate to the corners between the building windows 13 so as not to impede the architecture design of the building. The skid track 26 as can be best seen in FIGS. 4, 5 and 6 of the drawings has a back section 32 and guide channel 36 portions with a plurality of skid track folding sectional doors 41 which allows the insertion of a skid 50 into the guide channel 36 portion of the skid track 26. The skid track 26 can be constructed as a continuous section or consists of a plurality of aligned segments 27 connected by means of coupling sleeve 48, as can be best seen in FIG. 7 of the drawings.

Figure 4:
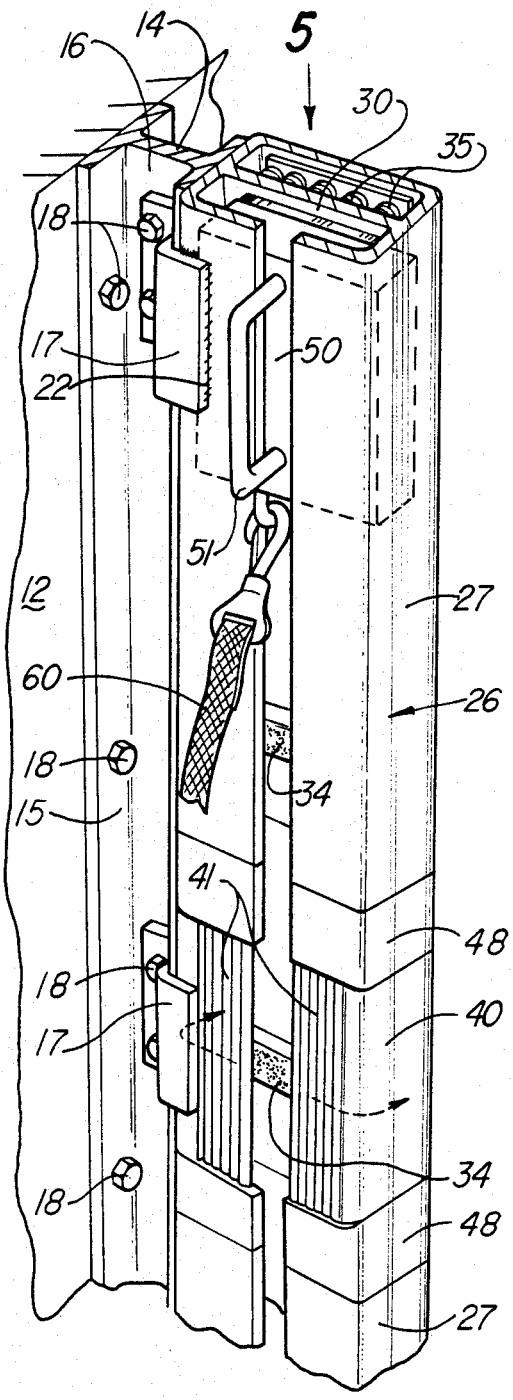
FIG. 4 is a fragmentary perspective view of a skid track folding sectional door assembly being attached to the outside of a highrise structure with the skid inserted into the skid track guide channel.
Figure 5:
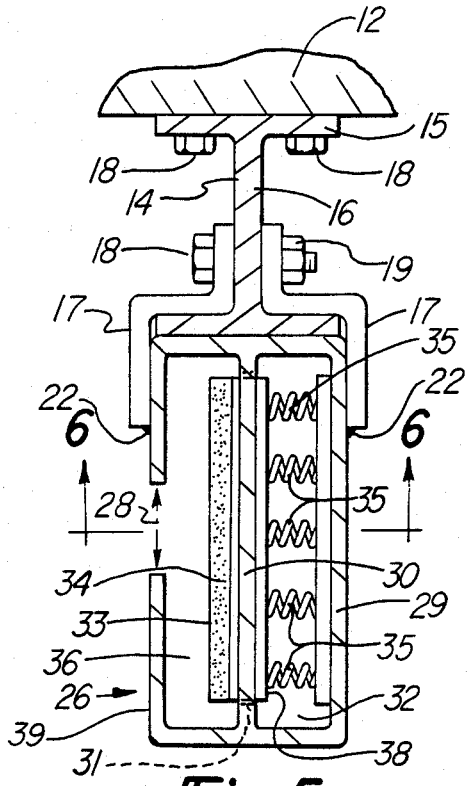
FIG. 5 is a crossing sectional view in the direction of arrow 5 showing the skid track.

Referring to FIGS. 4 and 5 of the drawings it can be seen that the skid track 26 is securely affixed to the outside wall 12 of a highrise structure 10 by means of I channel 14 and a plurality of clamps 17. The I channel 14 is attached to the outside wall 12 of the structure by a plurality of bolts 18 disposed along its flange 15. While the skid track 26 is securely attached to the I channel 14 by means of a plurality of clamps 17 disposed vertically along the length of the skid track 26, with the clamps 17 being attached to the web 16 of the I channel 14 by any suitable means, such as, a bolts 18 and nuts 19 combination. The clamp 17 is attached to the skid track 26 by any suitable means known in the art, and I have shown the use of a standard butt weld 22.

Figure 6:
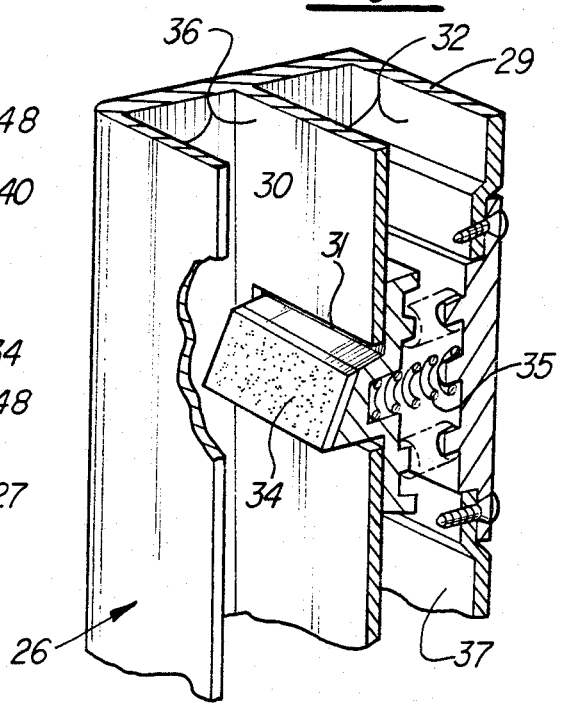
FIG. 6 is crossing sectional view taken in the direction of arrows 6—6 showing a fragmentary elevational view of the skid track.
Figure 7:
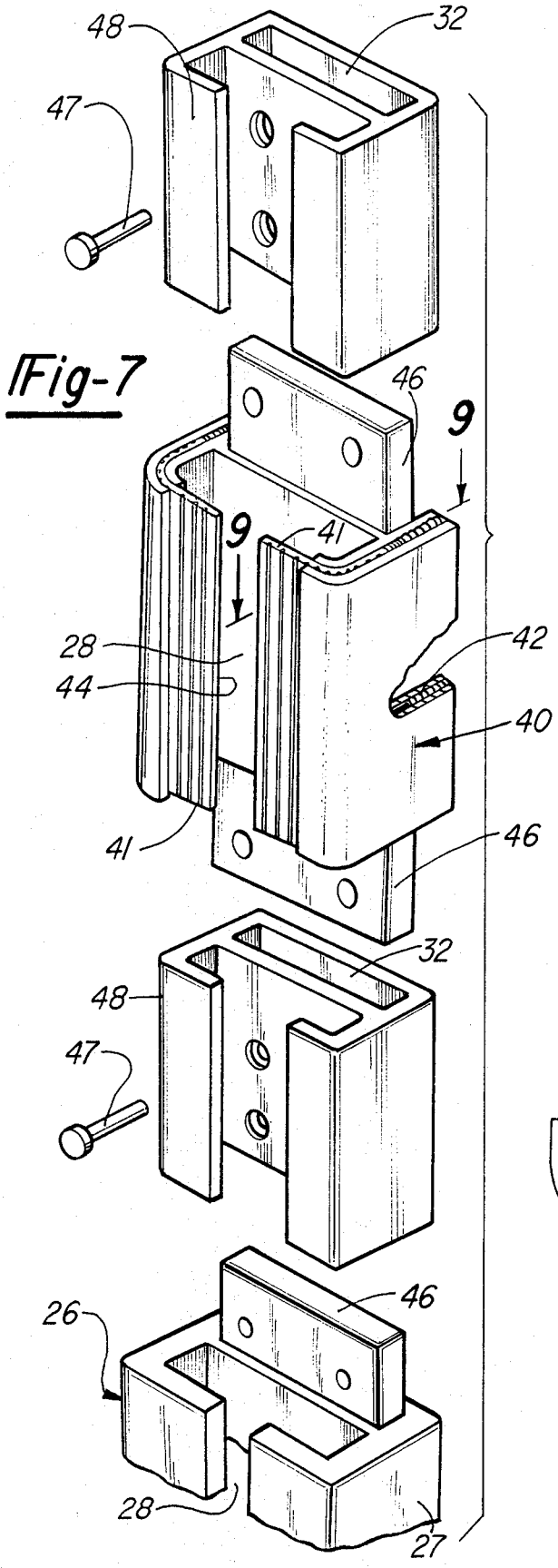
FIG. 7 is an exploded perspective view of a skid track door assembly having a folding sectional door showing how the coupling sleeve is attached thereto.

Referring now to FIGS. 5 and 6 of the drawings I now wish to describe in detail the skid track 26 as having a rectangular shape with a longitudinal aperture 28 running the entire length of the front side 39. Intermediate to longitudinal aperture 28 and back side 29 of the skid track 26 is partition 30 which divides the skid track 26 into a guide channel 36 and back section 32 compartments. The partiton 30 consisting of a plane surface that runs the entire longitudinal length of the skid track 26 with a plurality of rectangular apertures 31 traverse to its length. Thus, I have above described a skid track 26 vertically disposed and in a spaced relationship to a highrise structure outside wall 12 running the entire length of the structure to the ground having a back section 32 and a guide channel 36 being separated by a partition 30 disposed within said skid track 26. Disposed within the back section 32 of the skid track 26 are a plurality of descent retarders 33 which partially protrudes into the guide channel 36 of the skid track 26 through rectangular aperture 31 disposed within partition 30. Between the descent retarder 33 biased plane frictional surface 34 is interposed means for controlling the movement of the descent retarder 33, as the skid 50 descends past it, displacing it towards the back side 29 of the skid track 26.

While any controlling means which resist the horizontal displacement of the descent retarders 33 would suffice, I have disclosed as part of my preferred embodiment the use of plurality of springs 35 due to its simplicity in construction and lack of required maintenance. As can be seen by reference to FIGS. 5 and 6 of the drawing a plurality of springs 35 is interposed between descent retarder 33 and skid track 26 back side 29 which will also cause the return of the descent retarder 33 to the at rest position once the skid 50 passes it. The resistance to a horizontal displacement of the descent retarder 33 can be controlled and varied by the strength and number of the springs 35 used.

To accommodate the placement of the skid 50 into the skid track 26 guide channel 36 there are disposed a plurality of track door assembly 40 which are easily accessible at each floor level of a highrise structure 10.

Figure 3:
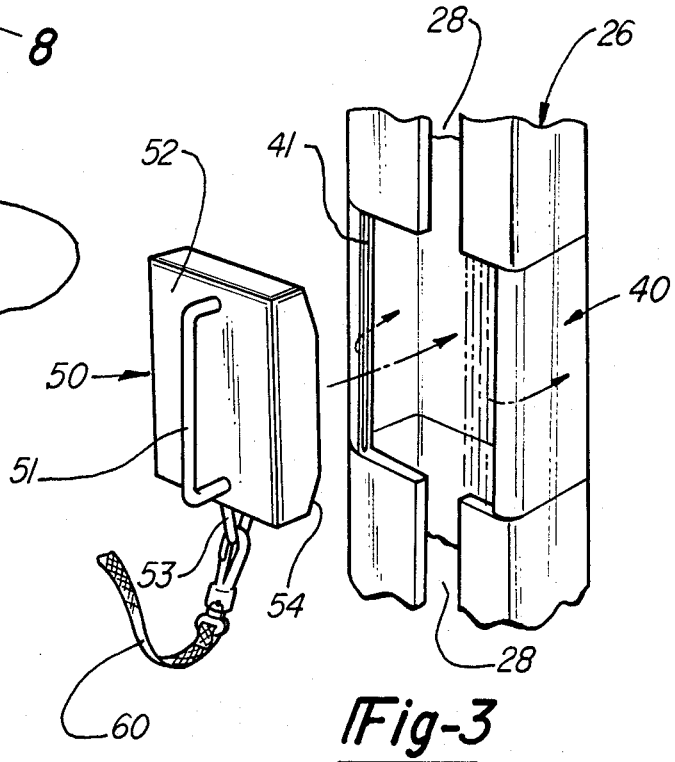
FIG. 3 is a fragmentary perspective view of a skid track and skid being inserted into the skid track guide channel through a folding sectinal door.
Figure 9:
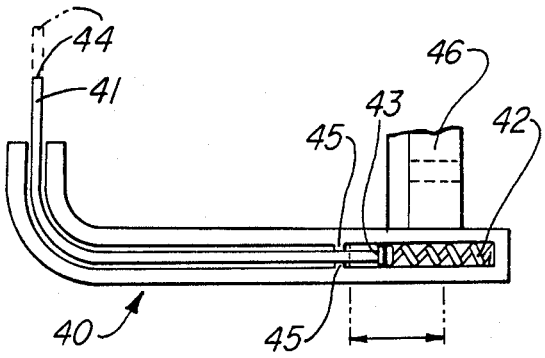
FIG. 9 is a cross-sectional view of a track door assembly taken along section lines 9—9 as shown in FIG. 7.

As can be best seen in FIGS. 3 and 9 of the drawings the folding sectional door 41 is so designed as to allow for its opening and automatic closing once a skid 50 is inserted into the guide channel 36 of the skid track 26. I have shown the use of a folding sectional door 41, in combination with a biased spring 42 which cause the return of the folding sectional door 41 to its at rest position so as to maintain the proper longitudinal aperture 28 opening at all times. A ridge 43 portion of said folding sectional door 41 is designed and placed thereon to prohibit the horizontal displacement of end 44 of the sliding section door 41 past the longitudinal aperture 28 of the skid track 26 due to tab 45 disposed at a predetermined location within the track door assembly 40.

Referring now to FIGS. 10, 11 and 12 of the drawings I now wish to disclose my preferred embodiment for a track door assembly 70 which utilizes a flapper plate doors 71 which in combination with a hinge 72 will always return the flapper plate door 71 to its closed position, as best seen in FIG. 10, so as to maintain the proper longitudinal aperture 28 opening at all times. The flapper plates 71 will move inwardly, as can be best seen in FIG. 12, upon the insertion of skid 50 and will return to its closed position once the insertion of the skid 50 is completed due to the force of the hinge 72 in combination with the gravitational pull. The use of the two flapper plates 71 being attached to the bottom lip 49 of coupling sleeve 48 by means of hinge 72 provides a simpler and more economic alternative to my above disclosed track door assembly 40, while at the same time provides an absolutely fool proof means of insuring that the flapper plate 71 maintains at all times the required opening at the longitudinal aperture 28. As can be seen by reference to FIG. 12 of the drawing, should the hinge 72 fail to properly close the flapper plate door 71 a skid 50 descending down guide channel 36 of the skid track 26 will cause the flapper plate door 71 to return to its closed position upon contact with said door.

As earlier mentioned, while the skid track 26 may be constructed as a continuous section with either a plurality of track door assembly 40 or 70 disposed therein, I wish to disclose as my preferred embodiment the use of a plurality of skid track 26 segments 27 which are connected together at any convenient length by means of a track door assembly 40 or 70 as best seen in FIGS. 4, 7, 10 and 11 of the drawings. The track door assembly 40 or 70 has two stems 46 which are inserted into back section 32 of coupling sleeve 48 and securely attached by means of bolts 47. To the opposite end of the coupling sleeve 48 is attached skid track 26 segment 27 and securely affixed by bolts 47.

Figure 2:
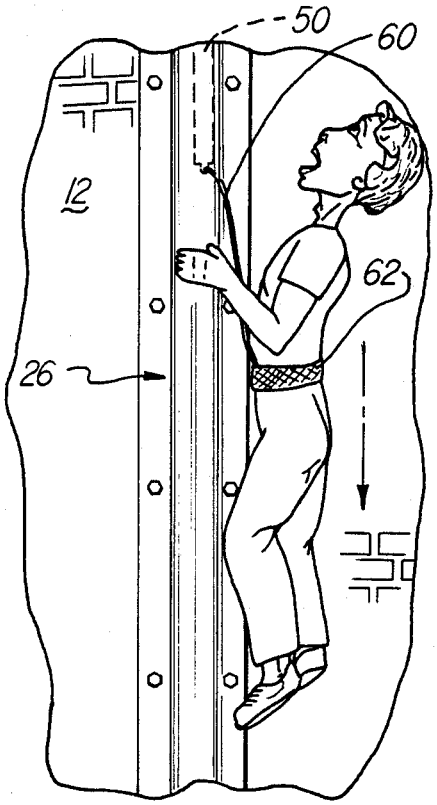
FIG. 2 depicts an occupant of a highrise structure escaping therefrom using my invention.

The skid 50 as can be best seen in FIG. 3 of the drawings has a handle 51 disposed and affixed to the back 52 of the skid 50. While at the bottom is affixed a loop 53 to which a clip or harness strap 60 may be attached. The skid 50 is designed so as to cooperatively fit into the guide channel 36 portion of the skid track 26 through either folding sectional doors 41 or flapper plate door 71. Once inside the guide channel 36 the skid may descend with the occupant of a highrise structure 10 being attached thereto by means of a harness 62 as best seen in FIG. 2 of the drawings.

Figure 8:
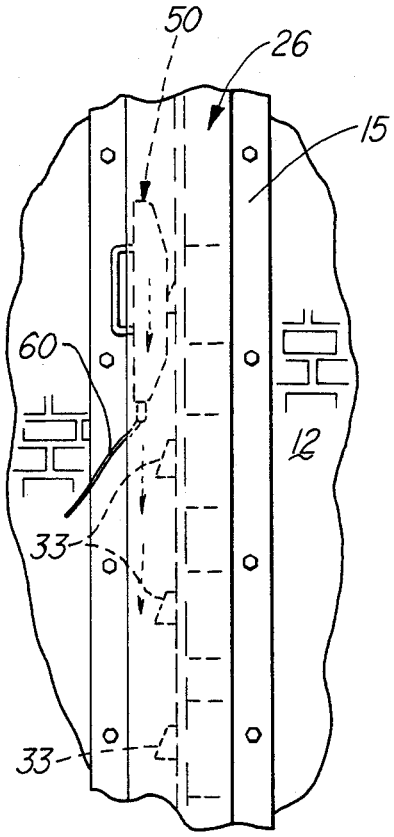
FIG. 8 is a fragmentary elevational view along line 8-8 of FIG. 1 showing the skid track attached to a highrise structure with the skid descending past a plurality of skid retarders.

The skid 50 is so designed as to allow its movement down the vertical skid track 26 with the occupant attached, with its rate of descent being controlled by a plurality of descent retarders 33 uniformly disposed along the skid track 26 entire length. As the skid 50 moves down the guide channel 36 of the skid track 26 its beveled front 54 comes into fractional contact with the biased plane frictional surface 34 of each protruding descent retarder 33 causing the descent retarder 33 to be displaced in a horizontal direction perpendicular to direction of the skid 50 movement, as can be best seen in FIG. 8 of the drawings. While I have disclosed the use of descent retarders 33 which are spaced uniformly along the entire length of the vertical skid track 26, they can also be placed in a closer configuration as they near the ground end of the vertical skid track 26 to more greatly impede the rate of descent or velocity of the user. To prevent the users forceful contact with the ground, it is also possible to provide a cluster configuration (not shown) of descent retarders suitably positioned above the ground. The movement of the descent retarders 33 in a horizontal direction is resisted by a plurality of springs 35 interposed between the rear 38 of the descent retarders 33 and the inside wall 37 of the back section 32 of the skid track 26.

Besides varying the spacing of the descent retarder 33 to control the rate of descend by the user, it is also possible to vary the spring 35 strength and number, which in turn will either increase or decrease the amount of force necessary to displace the descent retarder 33 by the skid 50 as it descends. The strength and number of the spring could be increased nearer the ground to prevent forceful contact by the user.

Finally as to materials used to construct my skid-out highrise fire escape device 20, it can be made from any type of standard materials, however, it would be preferred that the materials used be highly resistant to both fire and heat and have noncorrosive physical qualities, such as aluminum or high strength plastic.

Applicant having provided a detailed description of how to make his invention now wishes to describe how best to use it. First, it is important that the skid track 26 placement on the outside wall 12 of a highrise structure 10 be such as to be readily accessible for emergency evacuation. It is also imperative that the folding sectional doors 41 or flapper plate doors 71 be also readily accessible and reachable by any user. It is therefore contemplated that my skid-out highrise fire escape device 20 will be located adjacent to any emergency exit from the interior of a highrise building, such as a door, windows or balcony. Also, a plurality of skids 50 would be stored in areas adjacent to the emergency exits or two skids 50 could be placed in each room of the highrise structure with an ample supply of harnesses.

In the event of an emergency requiring exit from the highrise structure where conventional means are not available or safe the building occupant would first put on their harness. Second the harness strap 60 would be attached to the loop 53 of the skid 50. The occupant would then make their way to the nearest exit having a skid-out highrise fire escape device 20 skid track 26 and would open either the folding sectional doors 41 or flapper plate door 71 of the skid track 26 and insert the skid 50 into the guide channel 36 portion of said skid track 26, allowing the skid track folding sectional door 41 or flapper plate door 71 to close. Note, that the skid 50 may be easily inserted into the guide channel 36 of the vertical skid track 26 through any of the plurality of track doors 41 or 71 disposed along said skid track 26. The occupant then steps off the window sill, balcony or ledge as the case may be, and is safely and slowly allowed to descend to the ground.

It will be appreciated that numerous changes and modifications can be made to the embodiments disclosed herein without departing from the spirit and scope of this invention. Thus, by abandoning the prior art use of complicated and expensive fire escape devices, applicant by virtue of the above described construction, has been successful in achieving the objects of the invention listed above and has invented a highrise fire escape device gravity operated and particularly adaptable for use in highrise buildings and modern skyscraper structures as an emergency escape apparatus from any floor of a building for use in the rescue of an occupant who may be trapped and prevented from using the conventional stairways or elevator due to a natural or man-made disaster such as fire, electrical or power failure, building collapse or personal injury of the occupants, etc.

I claim:

1. An emergency gravity operated fire escape apparatus particularly useful for egressing from highrise type structures, which in combination, comprises:

a skid track vertically disposed and in a spaced relationship to a wall of a structure having a ground end, said skid track having a front side and a back side with a partition interposed between the front and the back side forming a guide channel and a back section having an inside wall, a longitudinal aperture disposed the length of the front side of said skid track and a plurality of doors disposed along said skid track's front side;

a plurality of descent retarders uniformly disposed within the back section of said skid track and partially protruding into the guide channel of said track through a rectangular aperture disposed within the partition, said descent retarder having a plane frictional surface and rear portion;

means for controlling said descent retarders horizontal displacement, said means for controlling being disposed within the back section of said skid track and placed between the rear of said descent retarder and the inside of the back side of said skid track; and a skid disposed within the guide channel of said skid track, said skid having a back and bevel front portions with a handle affixed to the back and a loop affixed near the bevel front portion; whereby a harness may be attached to the loop of said skid, allowing the user to safely and slowly descend to the ground during an emergency exit from a highrise structure.

2. An escape apparatus, as defined in claim 1, wherein the plurality of doors disposed along said skid track front side consists of folding sectional doors having a spring which causes the door to automatically close once said skid is inserted into the guide channel of said skid track, so as to maintain the proper longitudinal aperture opening.

3. An escape apparatus, as defined in claim 1, wherein the plurality of doors disposed along said skid track front side consists of flapper plate doors having a hinge which causes the door to automatically close once said skid is inserted into the guide channel of said skid track so as to maintain the proper longitudinal aperture opening.

4. An escape apparatus, as defined in claim 2, wherein said plurality of descent retarders are disposed in a close configuration near the ground end of said skid track.

5. An escape apparatus, as defined in claim 3, wherein said plurality of descent retarders are disposed in a close configuration near the ground end of said skid track.

6. An escape apparatus, as defined in claim 4, wherein said plurality of descent retarders are disposed in a cluster configuration near the ground end of said skid track.

7. An escape apparatus, as defined in claim 5, wherein said plurality of descent retarders are disposed in a cluster configuration near the ground end of said skid track.

8. An escape apparatus, as defined in claim 6, wherein said means for controlling the horizontal displacement of said descent retarders consists of springs interposed between the rear of said descent retarders and the inside of the back side of said skid track.

9. An escape apparatus, as defined in claim 7, wherein said means for controlling the horizontal displacement of said descent retarders consists of springs interposed between the rear of said descent retarders and the inside of the back side of said skid track.

10. An escape apparatus, as defined in claim 8, wherein the number and strength of the springs used as a means for controlling said descent retarders horizontal displacement increases as said descent retarders near the ground.

11. An escape apparatus, as defined in claim 9, wherein the number and strength of the springs used as a means for controlling said descent retarders horizontal displacement increases as said descent retarders near the ground.

12. An escape apparatus, as defined in claim 10, wherein said skid track and skid are made from aluminum.

13. An escape apparatus as defined in claim 10, wherein said skid track and skid are made from high strength plastic.

14. An escape apparatus as defined in claim 11, wherein said skid track and skid are made from aluminum.

15. An escape apparatus as defined in claim 11, wherein said skid track and skid are made from a high strength plastic.

16. An emergency gravity operated highrise fire escape device with a skid track vertically disposed and in a spaced relationship to a wall of highrise structure running the entire length of the structure to the ground, the emergency escape device comprising:

a skid disposed within the skid track which moves along a guide channel portions of the skid track in a vertical direction, said skid having a back and a bevel front portions with a handle affixed to the back and a loop affixed near the bevel front portion;

a plurality of descent retarders disposed within a back section of the skid track and partially protruding into the guide channel of the track through rectangular apertures disposed within a partition interposed between the guide channel and back section of said skid track, said descent retarders having a plane frictional surface and a rear portion;

means for controlling the vertical descent velocity of said skid; said means being disposed within the back section of the skid track and interposed between said descent retarders rear portion and the back section of the track; and a harness, which is connected to the loop of said skid for securing a user thereto;

whereby a user may safely and slowly descent to the ground during an emergency exit from a highrise structure using the emergency escape device.

17. An escape device, as defined in claim 16, further comprising; a plurality of folding sectional doors having a spring which causes said door to automatically close once said skid is inserted into the guide channel of the skid track.

18. An escape device, as defined in claim 16, further comprising; a plurality of flapper plate doors having a hinge which causes said door to automatically close once said skid is inserted into the guide channel of the skid track.

19. An escape device as defined in claim 17, wherein said plurality of descent retarders are disposed in a close configuration near the ground end of the skid track.

20. An escape device, as defined in claim 18, wherein said plurality of descent retarders are disposed in a close configuration near the ground end of the skid track.

21. An escape device, as defined in claim 19, wherein said plurality of descent retarders are disposed in a cluster configuration near the ground end of the skid track.

22. An escape device, as defined in claim 20, where said plurality of descent retarders are disposed in a cluster configuration near the ground end of the skid track.

23. An escape device, as defined in claim 21, wherein said means for controlling the vertical descent velocity of said skid consists of springs.

24. An escape device, as defined in claim 22, wherein said means for controlling the vertical descent velocity of said skid consists of springs.

25. An escape device, as defined in claim 23, wherein the number and strength of the springs used as means for controlling the vertical descent velocity of said skid increases as said plurality of descent retarders near the ground.

26. An escape device, as defined in claim 24, wherein the number and strength of the springs used as means for controlling the vertical descent velocity of said skid is increases as said plurality of descent retarders near the ground.

27. An escape device, as defined in claim 25, wherein said skid track and skid are made from aluminum.

28. An escape device, as defined in claim 25, wherein said skid track and skid are made from high strength plastic.

29. An escape device as defined in claim 26, wherein said skid track and skid are made from aluminum.

30. An escape device as defined in claim 26, wherein said skid track and skid are made from a high strength plastic.

31. An highrise fire escape apparatus, comprising:

a plurality of skid track segments, being vertically disposed and in a spaced relationship to a wall of a structure, having a lower ground end, said skid track segments having a front side and a back side with a partition interposed between the front and back sides forming a guide channel and a back section having an inside wall, and a longitudinal aperture running the length of the front side of said skid track segments, said skid track segments having a stem at each end;

a plurality of track door assemblies, said track door assemblies having a stem portion at both ends, a coupling sleeve cooperatively attached to both stem portions of said track door assemblies and said skid track segments, said track door assemblies also having a guide channel portion providing a continuous passage between the guide channel of said skid track segments;

a plurality of descent retarders uniformly disposed within the back section of said skid track segment and partially protruding into the guide channel of said skid tracks through a rectangular aperture disposed within the partition, said descent retarders having a plane frictional surface and rear portion;

means for controlling said descent retarders horizontal displacement, said means for controlling being disposed within the back section of said skid track segments and placed between the rear of said descent retarders and the inside of the back side of said skid track segments; and a skid disposed within the guide channel of said skid track segments, said skid having a back and bevel front portions with a handle affixed to the back and a loop affixed near the bevel front portion;

whereby a harness may be attached to the loop of said skid, allowing the user to safely and slowly descent to the ground during an emergency exit from a highrise structure.

32. An escape apparatus, as defined in claim 31, wherein said plurality of track door assemblies interposed between said skid track segments consists of a folding sectional doors having a spring which causes the doors to automatically close once said skid is inserted into the guide channel of said track door assembly so as to maintain the required longitudinal aperture opening.

33. An escape apparatus, as defined in claim 31, wherein said plurality of track door assemblies interposed between said skid track segments consists of a flapper plate door having a hinge which causes the door to automatically close once said skid is inserted into the guide channel of said track door assembly so as to maintain the required longitudinal aperture said flapper plate door being pivotly hinged to the coupling sleeve.

34. An escape apparatus, as defined in claim 32, wherein said plurality of descent retarders are disposed in a close configuration near the ground end of said skid track segments;

35. An escape apparatus, as defined in claim 33, wherein said plurality of descent retarders are disposed in a close configuration near the ground end of said skid track segments.

36. An escape apparatus, as defined in claim 34, wherein said plurality of descent retarders are disposed in a cluster configuration near the ground end of the skid track.

37. An escape apparatus, as defined in claim 35, wherein said plurality of descent retarders are disposed in a cluster configuration near the ground end of the skid track.

38. An escape apparatus, as defined in claim 36, wherein said means for controlling the horizontal displacement of said descent retarders consists of springs interposed between the rear of said descent retarders and the inside of the back side of said skid track.

39. An escape apparatus, as defined in claim 37, wherein said means for controlling the horizontal displacement of said descent retarders consists of springs interposed between the rear of said descent retarders and the inside of the backside of said skid track.

40. An escape apparatus, as defined in claim 38, wherein the number an strength of the springs used as a means for controlling said descent retarders horizontal displacement increases as said descent retarders near the ground.

41. An escape apparatus, as defined in claim 39, wherein the number and strength of the springs used as a means for controlling said descent retarders horizontal displacement increases as said descent retarder nears the ground.

42. An escape apparatus as defined in claim 40, wherein said skid track segments and skid are made from aluminum.

43. An escape apparatus as defined in claim 40, wherein said skid track segments and skid are made from high strength plastic.

44. An escape apparatus as defined in claim 41, wherein said skid track segments and skid are made from aluminum.

45. An escape apparatus as defined in claim 41, wherein said skid track segments and skid are made from a high strength plastic.

46. An emergency escape apparatus useful in egressing from highrise type structures, comprising;

a I-channel; said channel being vertically disposed and securely affixed to the outside wall of a highrise structure;

a plurality of skid track segments, being suitably connected to said I-channel to maintain a spaced relationship to the wall of the highrise structure having a lower ground end, said skid track segments having a front side and a back side with a partition interposed between the front and backsides forming a guide channel and a back section having an inside wall, and a longitudinal aperture running the length of the front side of said skid track segments said skid track segments having a stem at each end;

a plurality of track door assemblies; said track door assemblies having a stem portion at both ends, a coupling sleeve cooperatively attached to both stem portion of said track door assembly and said skid track segments, said track door assemblies also having a guide channel portion providing a continuous passage between the guide channel of said skid track segments;

a plurality of descent retarders uniformly disposed within the back section of said skid track segment and partially protruding into the guide channel of said skid tracks through a rectangular aperture disposed within the partition, said descent retarders having a plane frictional surface and rear portion;

means for controlling said descent retarder horizontal displacement, said means for controlling being disposed within the back section of said skid track segments and placed between the rear of said descent retarder and the inside of the backside of said skid track segments; and a skid disposed within the guide channel of said skid track segments, said skid having a back and bevel front portions with a handle affixed to the back and a loop affixed near the bevel front portion;

whereby a harness may be attached to the loop of said skid, allowing the user to safely and slowly descend to the ground during an emergency exit from a highrise structure.

47. An emergency escape apparatus, as defined in claim 46, wherein said plurality of track door assemblies interposed between said skid track segments consists of a folding sectional doors having a spring which causes the doors to automatically close once said skid is inserted into the guide channel of said track door assembly so as to maintain the required longitudinal aperture opening.

48. An emergency escape apparatus, as defined in claim 46, wherein said plurality of track door assemblies interposed between said skid track segments consists of a flapper plate doors having a hinge which causes the doors to automatically close once said skid is inserted into the guide channel of said track door assembly so as to maintain the required longitudinal aperture opening, said flapper plate door being pivotly hinged to the coupling sleeve.

49. An emergency escape apparatus, as defined in claim 47, wherein said plurality of descent retarders are disposed in a close configuration near the ground end of said skid track segments.

50. An emergency escape apparatus, as defined in claim 48, wherein said plurality of descent retarders are disposed in a close configuration near the ground end of said skid track segments.

51. An emergency escape apparatus, as defined in claim 49, wherein said plurality of descent retarders are disposed in a cluster configuration near the ground end of the skid track.

52. An emergency escape apparatus, as defined in claim 50, wherein said plurality of descent retarders are disposed in a cluster configuration near the ground end of the skid track.

53. An emergency escape apparatus, as defined in claim 51, wherein said means for controlling the horizontal displacement of said descent retarders consists of springs interposed between the rear of said descent retarders and the inside of the backside of said skid track.

54. An emergency escape apparatus, as defined in claim 52 wherein said means for controlling the horizontal displacement of said descent retarders consists of springs interposed between the rear of said descent retarders and the inside of the backside of said skid track.

55. An emergency escape apparatus as defined in claim 53, wherein the number and strength of the springs used as a means for controlling said descent retarders horizontal displacement increase as said descent retarder nears the ground.

56. An emergency escape apparatus, as defined in claim 54, wherein the number and strength of the springs used as means for controlling said descent retarders horizontal displacement increases as said descent retarder nears the ground.

57. An emergency apparatus, as defined in claim 55, wherein said skid track segments and skid are made from aluminum.

58. An emergency escape apparatus as defined in claim 55, wherein said skid track segments and skid are made from high strength plastic.

59. An emergency escape apparatus as defined in claim 56, wherein said skid track segments and skid are made from aluminum.

60. An emergency escape apparatus as defined in claim 56, wherein said skid track segments and skid are made from a high strength plastic.

* * * * *